US012618227B2

(12) United States Patent
Suzuki

(10) Patent No.: US 12,618,227 B2
(45) Date of Patent: May 5, 2026

(54) METHOD FOR CONTROLLING WORK ASSISTANCE SYSTEM, AND PROGRAM FOR CONTROLLING WORK ASSISTANCE SYSTEM

(71) Applicant: NIPPON SEIKI CO., LTD., Niigata (JP)

(72) Inventor: Masamichi Suzuki, Niigata (JP)

(73) Assignee: Nippon Seiki Co., Ltd., Niigata (JP)

( * ) Notice: Subject to any disclaimer, the term of this patent is extended or adjusted under 35 U.S.C. 154(b) by 250 days.

(21) Appl. No.: 18/257,443

(22) PCT Filed: Mar. 10, 2022

(86) PCT No.: PCT/JP2022/010479

§ 371 (c)(1),
(2) Date: Jun. 14, 2023

(87) PCT Pub. No.: WO2022/264556

PCT Pub. Date: Dec. 22, 2022

(65) Prior Publication Data

US 2024/0076855 A1 Mar. 7, 2024

(30) Foreign Application Priority Data

Jun. 15, 2021 (JP) ..... 2021-099304

(51) Int. Cl.
*E02F 9/26* (2006.01)
*E02F 3/43* (2006.01)

(52) U.S. Cl.
CPC ..... *E02F 9/264* (2013.01); *E02F 3/435* (2013.01)

(58) Field of Classification Search
CPC ..... E02F 9/264; E02F 3/435
See application file for complete search history.

(56) References Cited

U.S. PATENT DOCUMENTS

2015/0066312 A1 3/2015 Sakuda et al.
2016/0348343 A1* 12/2016 Kanemitsu ..... G01S 19/14
(Continued)

FOREIGN PATENT DOCUMENTS

JP 2014-137343 A 7/2014
JP 2018-155027 A 10/2018
(Continued)

OTHER PUBLICATIONS

International Search Report issued in corresponding International Application No. PCT/JP2022/010479, dated May 31, 2022, w/ English Translation (4 pages).

*Primary Examiner* — Ig T An
(74) *Attorney, Agent, or Firm* — Rimon P.C.

(57) ABSTRACT

The present invention enables proper assistance of an operation by an operator even when a sensor is not disposed in the correct position. In a method for controlling a work assistance system that assists work of an operator by using a machine guidance function, the work assistance system comprises: a sensor unit that is held by a moving part of a construction machine and acquires attitude information by using a sensor; and a portable information terminal device that acquires, by means of data communication with the sensor unit, the attitude information acquired by the sensor unit, and that, on the basis of the attitude information, reports information for assisting an operation by the operator. The method for controlling the work assistance system comprises: an imaging result acquisition step for acquiring an imaging result from the moving part having the sensor unit; an error calculation step for subjecting the imaging result to image processing to calculate a mounting error of the sensor unit with respect to a reference mounting position; and a correction step for using the mounting error to correct the attitude information.

9 Claims, 11 Drawing Sheets

(56) References Cited

U.S. PATENT DOCUMENTS

| | | | | |
|---|---|---|---|---|
| 2019/0066323 | A1* | 2/2019 | Li | G06F 18/22 |
| 2019/0277880 | A1* | 9/2019 | Kinoshita | G01S 19/47 |
| 2019/0345697 | A1 | 11/2019 | Ishihara et al. | |
| 2020/0041539 | A1* | 2/2020 | Nakaoka | G01P 21/00 |
| 2022/0049477 | A1 | 2/2022 | Yamaka et al. | |
| 2022/0056674 | A1 | 2/2022 | Ishihara et al. | |

FOREIGN PATENT DOCUMENTS

| | | | |
|---|---|---|---|
| JP | 2019-173407 | A | 10/2019 |
| JP | 2020-105802 | A | 7/2020 |
| JP | 2020-122283 | A | 8/2020 |

* cited by examiner

METHOD FOR CONTROLLING WORK ASSISTANCE SYSTEM, AND PROGRAM FOR CONTROLLING WORK ASSISTANCE SYSTEM

CROSS REFERENCE TO RELATED APPLICATIONS

This application is the U.S. National Phase under 35 U.S.C. § 371 of International Application No. PCT/JP2022/010479, filed on Mar. 10, 2022, which claims the benefit of Japanese Application No. 2021-099304, filed on Jun. 15, 2021, and the entire contents of each are hereby incorporated by reference.

TECHNICAL FIELD

The present invention relates to a method for controlling a work assistance system and a program for a controlling a work assistance system, and can be applied to a hydraulic shovel, for example.

BACKGROUND ART

Conventionally, construction machines (the so-called ICT construction machinery) in which a machine guidance function is incorporated have been provided.

The machine guidance refers to a technology of supporting an operation of a construction machine by using a measurement technology such as total station (TS) and a global navigation satellite system (GNSS). With the machine guidance, it is possible to appropriately assist an operator with the work, and improve the work efficiency, safety, and work accuracy.

With respect to such ICT construction machinery, Patent Document 1 discloses a configuration for correcting a deviation in a hydraulic cylinder stroke length.

PRIOR ART DOCUMENT

Patent Document

Patent Document 1: JP 2014-137343 A

SUMMARY OF THE INVENTION

Problems to be Solved by the Invention

Incidentally, the machine guidance function may be introduced into an existing construction machine by mounting a sensor or the like thereon afterward.

However, when a sensor is arranged afterward in this way, a case where the sensor is not arranged at the correct position may be expected. In addition, a case where a sensor is replaced for maintenance or the like may be expected, and also in this case, it is expected that the sensor may not be arranged at the correct position.

In the ICT construction machinery, if the sensor is not arranged at the correct position as in the above case, it may be difficult to accurately assist an operation of an operator.

The present invention has been conceived in consideration of the above points, and it is an object of the present invention to propose a method for controlling a work assistance system and a program for a controlling a work assistance system which can accurately assist an operation of an operator even when a sensor is not arranged at the correct position.

Solution to Problem

In order to resolve such a problem, a method for controlling a work assistance system according to a first aspect of the present invention pertains to a method for controlling a work assistance system which assists work of an operator by a machine guidance function, in which the work assistance system includes: a sensor unit which is held on a moving part of a working machine and acquires posture information by a sensor; and a portable information terminal device which acquires the posture information acquired by the sensor unit via data communication with the sensor unit, and notifies the operator of information for assisting an operation of the operator on the basis of the posture information. The method for controlling the work assistance system includes: an imaging result acquisition step of acquiring an imaging result of the moving part including the sensor unit; an error calculation step of performing image processing on the imaging result, and calculating a mounting error of the sensor unit with respect to a reference mounting position; and a correction step of correcting the posture information in view of the mounting error.

According to the configuration of the first aspect, by calculating the mounting error of the sensor unit with respect to the reference mounting position and correcting the posture information, even when a sensor is not arranged at the correct position, an operation of the operator can be accurately assisted.

Further, a program for a controlling a work assistance system according to a second aspect of the present invention pertains to a program for controlling a work assistance system causing, by being executed by an arithmetic processing circuit, a predetermined processing procedure to be executed, in which the work assistance system includes: a sensor unit which is held on a moving part of a working machine and acquires posture information by a sensor; and a portable information terminal device which acquires the posture information acquired by the sensor unit via data communication with the sensor unit, and notifies the operator of information for assisting an operation of the operator on the basis of the posture information. The processing procedure includes: an imaging result acquisition step of acquiring an imaging result of the moving part including the sensor unit; an error calculation step of performing image processing on the imaging result, and calculating a mounting error of the sensor unit with respect to a reference mounting position; and a correction step of correcting the posture information in view of the mounting error.

According to the configuration of the second aspect, by calculating the mounting error of the sensor unit with respect to the reference mounting position and correcting the posture information, even when a sensor is not arranged at the correct position, an operation of the operator can be accurately assisted.

Effect of the Invention

According to the present invention, even when the sensor is not arranged at the correct position, the operation of the operator can be accurately assisted.

MODE FOR CARRYING OUT THE INVENTION

First Embodiment

Figure 1:
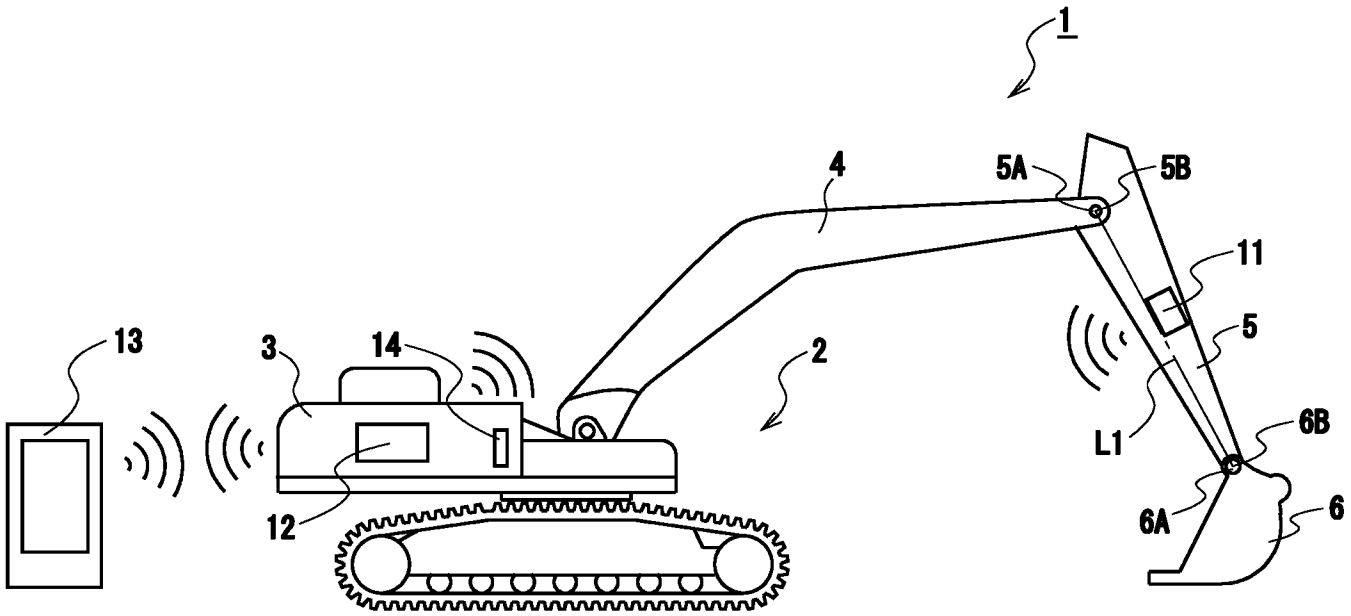
FIG. 1 is a diagram illustrating a work assistance system according to a first embodiment of the present invention.
Figure 2:
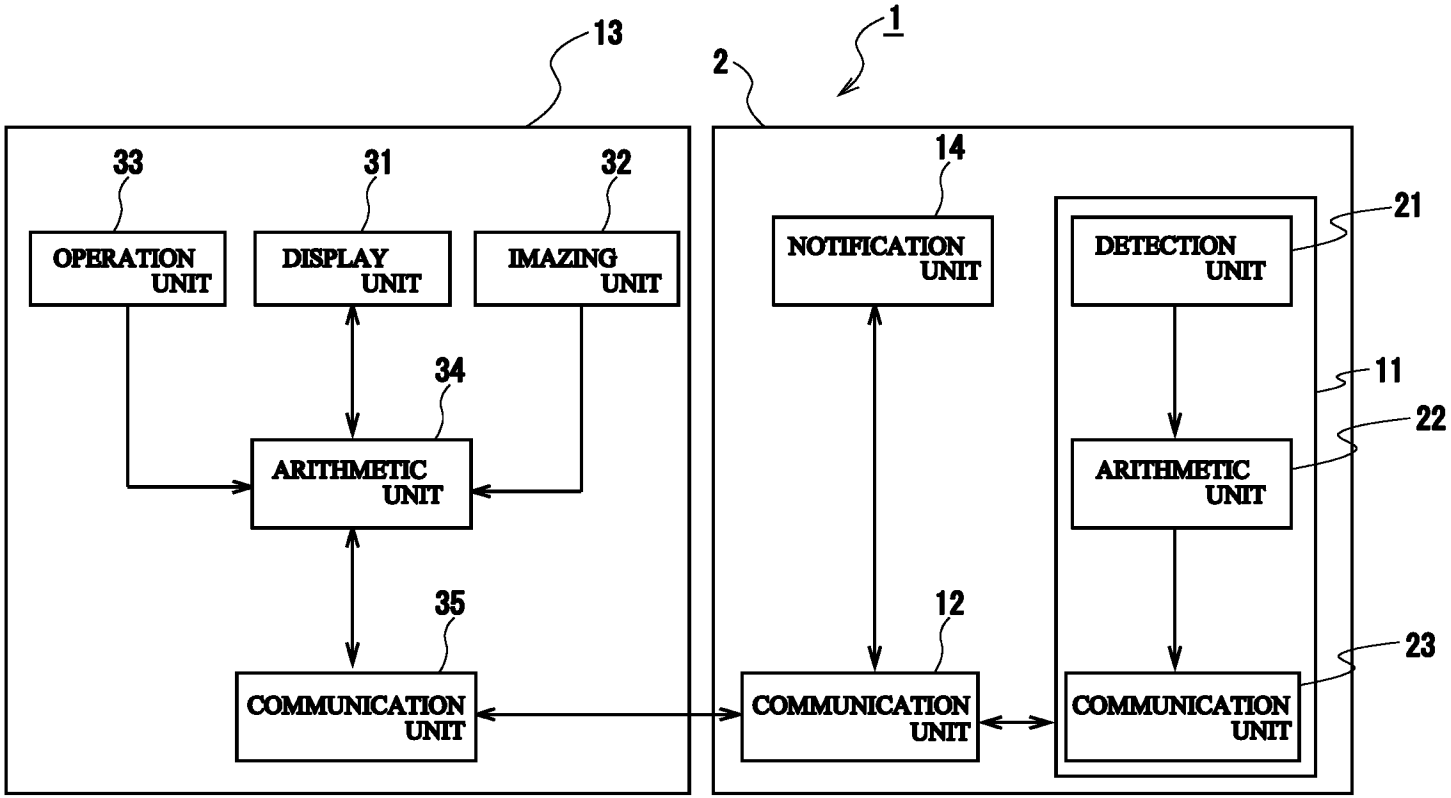
FIG. 2 is a block diagram of the work assistance system in FIG. 1.

FIG. 1 is a diagram illustrating a work assistance system 1 according to a first embodiment of the present invention, and FIG. 2 is a block diagram.

The work assistance system 1 is applied to a hydraulic shovel 2, which is a construction machine (a working machine), to assist an operator who operates the hydraulic shovel 2 by a machine guidance function in performing the work.

The hydraulic shovel 2 includes a body 3 that is self-propelled by caterpillar drive, and on the body 3, a boom 4, an arm 5, and a bucket 6 are sequentially provided. Machines to be assisted by the work assistance system 1 are not limited to a hydraulic shovel, and the work assistance system 1 can be widely applied to various construction machines used for civil engineering and construction works, such as a construction machine to be used for ground improvement.

The work assistance system 1 is provided with a sensor unit 11, a communication unit 12, a portable information terminal device 13, and a notification unit 14.

The sensor unit 11 is provided on the arm 5 corresponding to a moving part of the hydraulic shovel 2, and acquires posture information by means of a sensor and outputs the acquired posture information to the communication unit 12. The posture information is information from which the posture of the arm 5 corresponding to the moving part can be detected. In the present embodiment, angle information of the arm 5 with respect to a horizontal direction is applied as the posture information.

Note that the sensor unit may be provided on each of the boom 4, the arm 5, and the bucket 6, or may be provided on either the boom 4 or the bucket 6. In other words, the sensor unit can be provided at various parts as needed.

Accordingly, as illustrated in FIG. 2, the sensor unit 11 is operated by power of a battery, which is not illustrated, to acquire three-dimensional acceleration and angular velocity information by means of a detection unit 21 including the sensor. Also, the posture information is detected by processing, by an arithmetic unit 22, the information detected by the detection unit 21, and is sent to the communication unit 12 via wireless data communication conducted by a communication unit 23. As described above, since the sensor unit 11 is operated by power of a battery and the posture information is sent by wireless communication, there is no need to separately provide cables for power supply and data communication for the sensor unit 11, and the sensor unit 11 can be easily installed at a desired place to be mounted. Consequently, with respect to the work assistance system 1, a machine guidance function can be easily introduced into an existing machine tool, and moreover, the machine guidance function can be improved.

More specifically, for the sensor of the detection unit 21, an inertial measurement unit (IMU) sensor is applied, and for the wireless communication by the communication unit 23, Bluetooth (registered trademark) is applied. Note that various configurations capable of detecting posture information can be widely applied to the detection unit 21, and also, various configurations capable of performing data communication can be widely applied to the wireless communication.

The communication unit 12 is provided on the body 3 of the hydraulic shovel 2, and collects the posture information acquired by the sensor unit 11 via the data communication with the sensor unit 11 and outputs the collected posture information to the portable information terminal device 13.

Further, conversely, the communication unit 12 acquires data to be output from the portable information terminal device 13 and outputs the data to the notification unit 14.

The notification unit 14 is configured to notify, in a driver's seat of the hydraulic shovel 2, an operator of information for assisting an operation of the operator. In the present embodiment, the notification unit 14 is formed from an image display device. For the information for assisting the operation of the operator, various kinds of information with which the operation of the operator can be assisted, such as the current work construction position relative to a work construction target, can be applied. However, in the present embodiment, an angle of the arm 5 with respect to a reference direction (for example, the horizontal direction) is applied, and the present embodiment is configured such that an inclination of the arm 5 can be easily and precisely confirmed by this feature. The notification unit 14 may notify the information for assisting the operation of the operator by a voice or a warning sound, and may be shared with the portable information terminal device 13.

The portable information terminal device 13 is the so-called smartphone or tablet terminal, and calculates information for assisting the operation of the operator on the basis of the posture information from the sensor unit 11 obtained via the communication unit 12.

More specifically, the portable information terminal device 13 is provided with a display unit 31, an imaging unit 32, an operation unit 33, an arithmetic unit 34, and a communication unit 35. Here, the display unit 31 is formed from an image display panel such as a liquid crystal display panel, and displays various kinds of image information pertaining to the portable information terminal device 13. The operation unit 33 is formed from a touch panel or the like arranged on the display unit 31, and detects various operations by the operator. The imaging unit 32 acquires an imaging result in response to an operation of the operator under the control of the arithmetic unit 34.

The communication unit 35 carries out input and output of the posture information, information for assisting the operation of the operator, etc., to and from the communication unit 12 via data communication by wireless communication.

The arithmetic unit 34 is an arithmetic processing circuit which executes application software pertaining to the work assistance system 1. The arithmetic unit 34 displays various kinds of image information on the display unit 31, switches the action of the portable information terminal device 13 by an operation to the operation unit 33, and further switches the action of the work assistance system 1.

Figure 3:
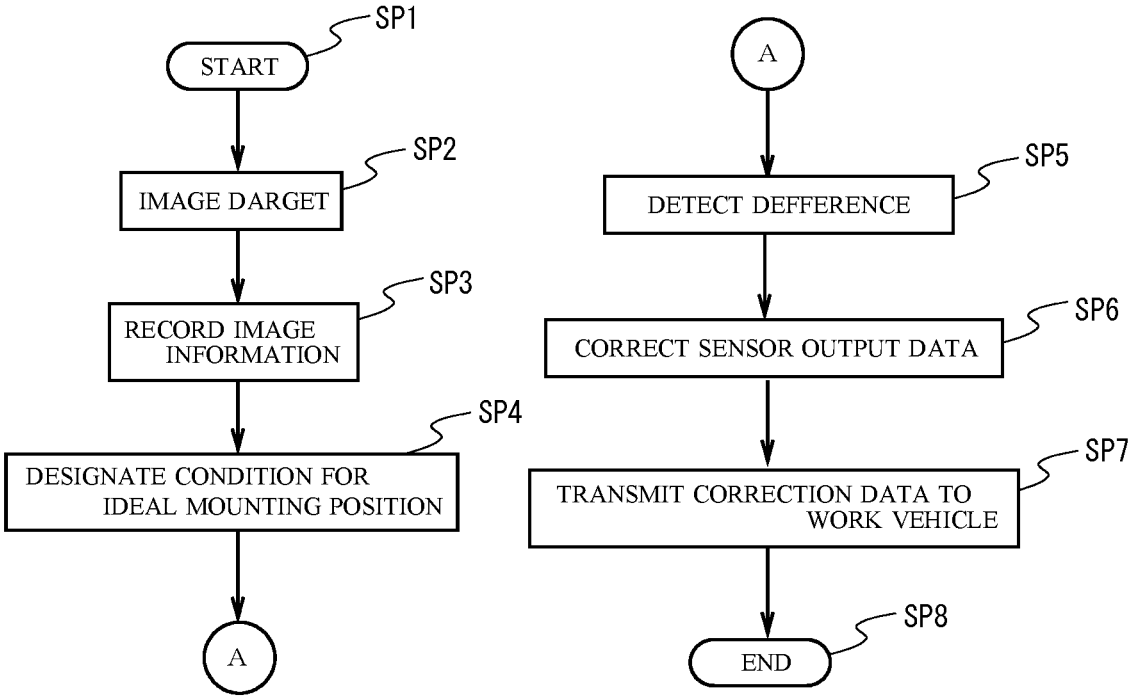
FIG. 3 is a flowchart showing a processing procedure of an arithmetic unit.

When the arithmetic unit 34 controls the action of each part as described above and the operator gives an instruction for setup processing, the arithmetic unit 34 executes a processing procedure illustrated in FIG. 3, calculates a mounting error of the sensor unit 11 with respect to a reference mounting position, and registers data for correcting the posture information detected by the sensor unit 11. The arithmetic unit 34 corrects, by using the registered data, the posture information input from the communication units 12 and 35, and sends out the corrected posture information as information for assisting the operation of the operator.

Specifically, when the setup processing is started, the arithmetic unit 34 instructs the operator to capture an image of the sensor unit 11, which is to be used for error calculation, by a display of the display unit 31, and records image information on the imaging result obtained via the imaging unit 32 (SP1-SP2-SP3) (i.e., an imaging result acquisition step). Here, the imaging unit 32 instructs that an imaging result should be acquired by a certain size including rotary shafts 5A and 6A at both ends of the arm 5 corresponding to the moving part on which the sensor unit 11, which is an imaging target object, is provided, such that a mounting error of the sensor unit 11 can be sufficiently detected by the display of the display unit 31 as illustrated, for example, in FIG. 4. As described above, the present example is configured such that the imaging result can be acquired by capturing an image of the hydraulic shovel 2 (e.g., the moving part such as the arm 5) by the imaging unit 32 provided in the portable information terminal device 13.

Figure 4:
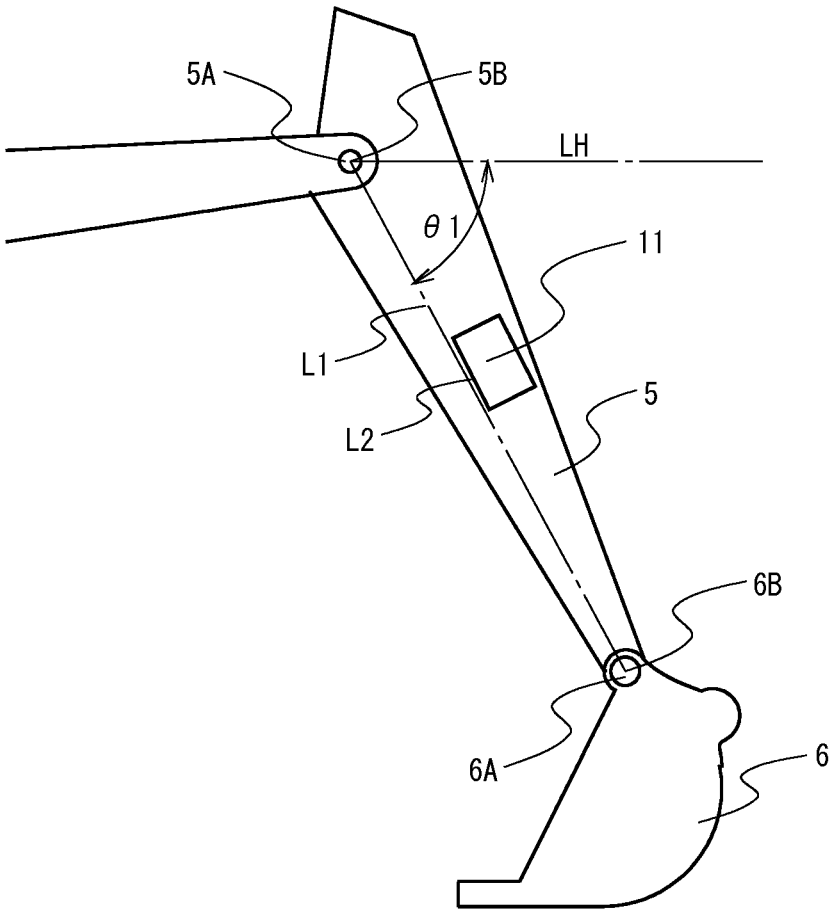
FIG. 4 is a diagram for use in describing the processing procedure in FIG. 3.

Next, the arithmetic unit 34 receives designation of a condition for an ideal mounting position (a reference mounting position) which corresponds to a detection reference for detecting the mounting error (SP4). The ideal mounting position is intended as a mounting position at which the sensor unit 11 is to be correctly positioned and mounted. The arithmetic unit 34 receives the designation of the condition by the operator's selection according to the sensor unit 11 by displaying, for example, a selectable ideal mounting position on the display unit 31. The arithmetic unit 34 performs image processing on the imaging result according to the condition designation, and sets a detection reference for detecting the mounting error. FIG. 4 shows an example of a case where a straight line L1 connecting rotation centers 5B and 6B of the rotary shafts 5A and 6A is set, on the basis of the designation of the condition, to the detection reference for detecting the mounting error. In FIG. 4, a horizontal line which corresponds to a detection reference for detecting the posture information by the sensor unit 11 is indicated by reference numeral LH.

Next, the arithmetic unit 34 performs image processing on the imaging result and detects a mounting angle of the sensor unit 11 relative to the straight line L1 related to the ideal mounting position. By doing so, the arithmetic unit 34 calculates the mounting error of the sensor unit 11 relative to the ideal mounting position (SP5) (i.e., an error calculation step). In the example illustrated in FIG. 4, the sensor unit 11 is formed in a rectangular shape, as the outer shape thereof, in plan view, and the arrangement in which a long side L2 of the rectangular shape is parallel to the straight line L1 is the correct mounting position. By this arrangement, the mounting angle of the sensor unit 11 with respect to the straight line L1 is zero degrees, and the posture information of the arm 5 can be accurately detected by the sensor unit 11.

Figure 5:
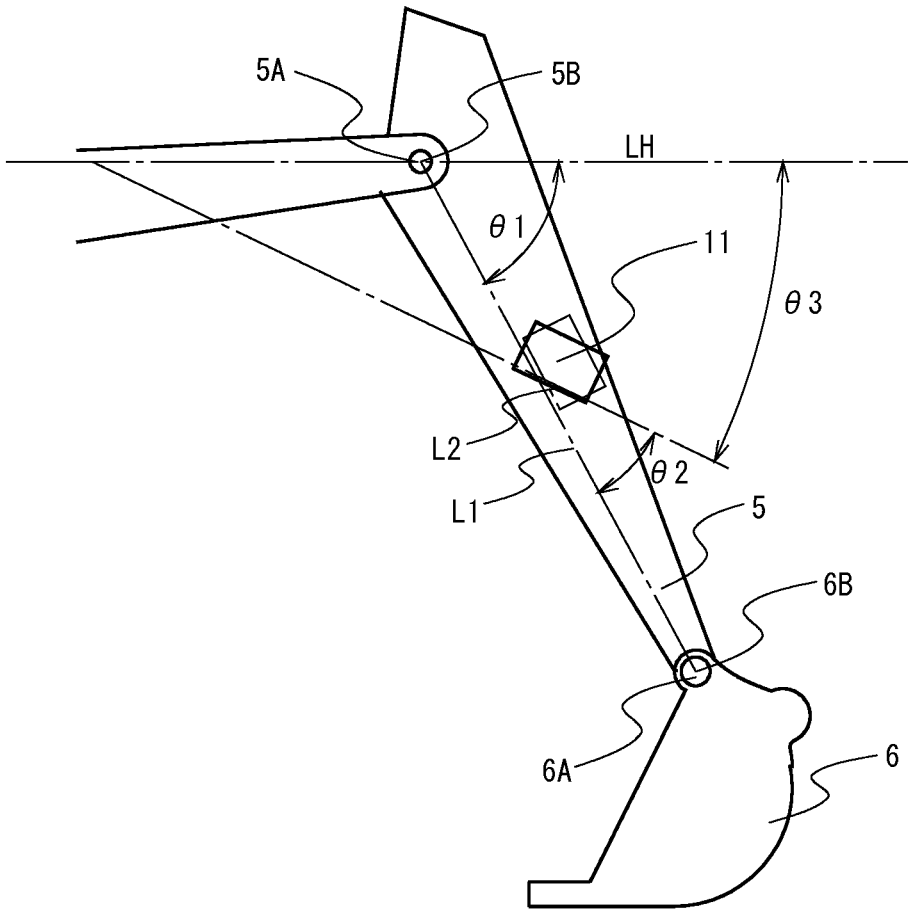
FIG. 5 is a diagram for use in describing a positional displacement of a sensor unit.

In contrast, FIG. 5 shows an example in which the sensor unit 11 is positionally displaced and mounted with an inclination, as compared to FIG. 4. In this case, the arithmetic unit 34 is to detect angle θ2 that the long side L2 forms with respect to the straight line L1.

The arithmetic unit 34 registers angle θ2 that the long side L2 forms with respect to the straight line L1 detected as described above as data for correcting the posture information that has been detected by the sensor unit 11.

Consequently, the arithmetic unit 34 corrects, by using the registered data, the posture information input from the communication units 12 and 35 (SP6) (i.e., a correction step), and sends the corrected posture information as information for assisting the operation of the operator (SP7). Here, it is assumed that the posture information from the sensor unit 11, which is arranged at angle θ2 as described above, is detected as being angle θ3. If the angle detected when the sensor unit 11 is arranged at the correct mounting position is θ1, angles θ1, θ2, and θ3 can be represented by the expression $\theta 1=\theta 2+\theta 3$. Consequently, the arithmetic unit 34 corrects the posture information by adding angle θ2, which is obtained from the registered data, to angle θ3 corresponding to the posture information input from the communication units 12 and 35.

According to the above configuration, by calculating the mounting error of the sensor unit with respect to the reference mounting position and correcting the posture information, even when a sensor is not arranged at the correct position, the operation of the operator can be accurately assisted. Further, a setup can be performed by an operator by using an information mobile terminal, and the setup can be performed by a simple operation of image-capturing and an operation of selecting an ideal mounting position.

Furthermore, since there is no need to correct the mounting position of the sensor unit 11, the work of mounting the sensor unit 11 can be executed easily, and correct posture information can be provided as appropriate by using the communication function of the information mobile terminal.

Second Embodiment

Figure 6:
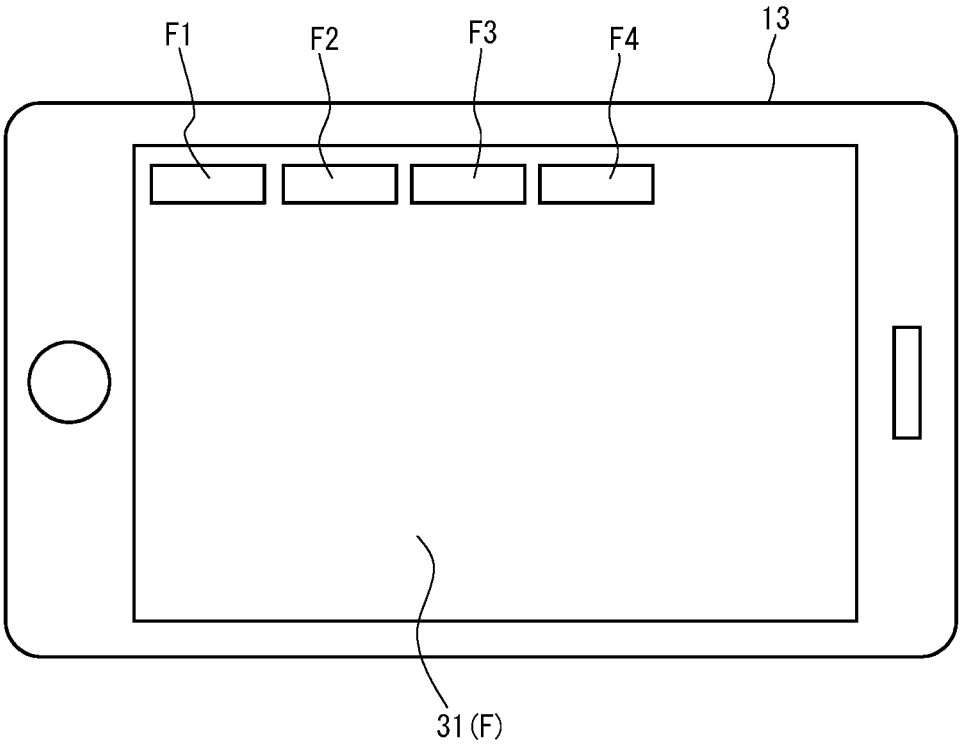
FIG. 6 is a diagram illustrating the state in which icons related to operational assistance are displayed on a portable information terminal device according to a second embodiment of the present invention.

Next, a second embodiment of the present invention will be described with reference to FIGS. 6 and 7. The second embodiment is configured to supplementarily display imaging assistance information 40 on a display unit 31 of a portable information terminal device 13 before an image-capturing person who captures an image of an imaging target object of a hydraulic shovel 2 (or an operator) uses an imaging unit 32 to capture an image of the imaging target object of the hydraulic shovel 2 including at least rotary shafts 5A and 6A at both ends of an arm 5 (a moving part) provided with the sensor unit 11 illustrated in FIG. 4. The imaging assistance information 40 has the function of assisting the image-capturing person (or the operator) with how to capture an image when he/she is uncertain of the way to capture an image of the imaging target object.

Here, it is assumed that as the image-capturing person (or the operator) touch-operates a functionality expansion icon, which is omitted from the illustration, being displayed on the display unit 31 (i.e., provided as an operation unit 33), an initial screen F to be presented at the time of imaging, which consists of an imaging area icon F1, a silhouette icon F2, an imaging example icon F3, and a silhouette selection icon F4, is displayed on the upper part of the display unit 31. If necessary, the initial screen may display a message which instructs that the icons F1 to F4, which serve as the operation unit 33, should be selected, as appropriate.

Figure 7:
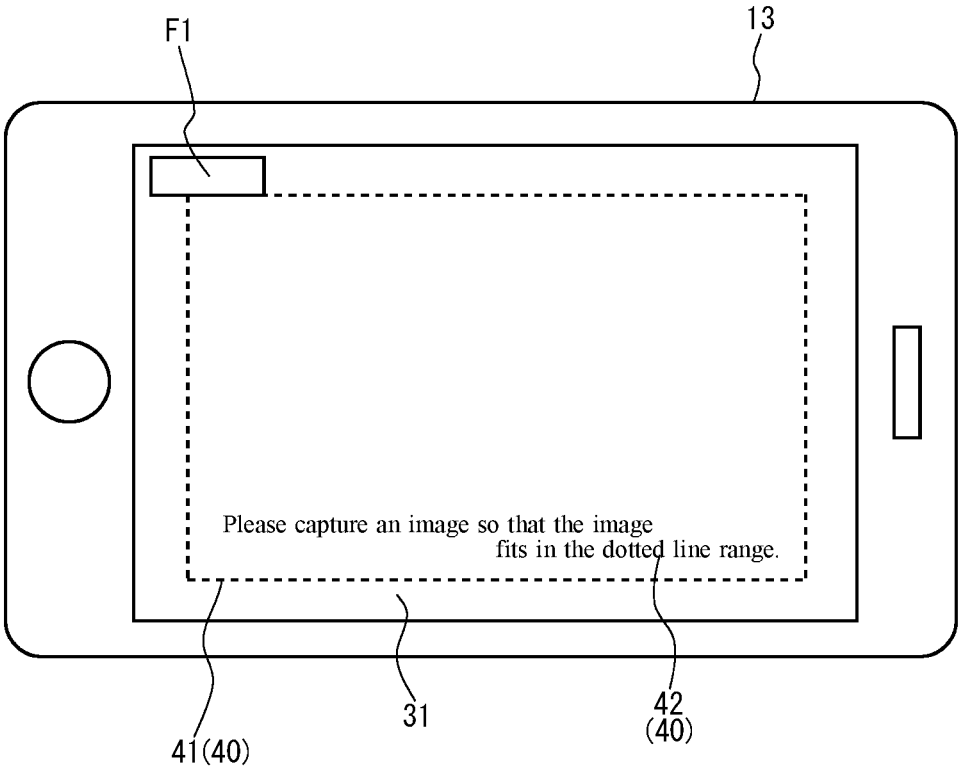
FIG. 7 is a diagram illustrating a portable information terminal device when an imaging area icon according to the second embodiment is operated.

The imaging assistance information 40 according to the second embodiment is configured to include, for example, imagable area information 41 which is displayed on the display unit 31 and notifying information 42 associated with the imagable area information 41, which is also displayed on the display unit 31, as illustrated in FIG. 7.

The imagable area information 41 corresponds to a substantially rectangular mark (a mark) which is presented to the image-capturing person (the operator) to indicate, as an image, a range in which imaging is enabled for the imaging target object. The imagable area information 41 is displayed on the display unit 31 when the image-capturing person (or the operator) touch-operates the imaging area icon F1 on the initial screen F. The imagable area information 41 is set, for example, to an area excluding an outer edge part of the display unit 31 (e.g., a display area which accounts for about 80% of the maximum display area). Also, the shape of the imagable area information 41 is not limited to a rectangular shape, but can be set to any arbitrary shape such as a trapezoidal shape or a parallelogram. Note that the silhouette icon F2, the imaging example icon F3, and the silhouette selection icon F4 are hidden from display when the image-capturing person (or the operator) touch-operates the imaging area icon F1.

Figure 8:
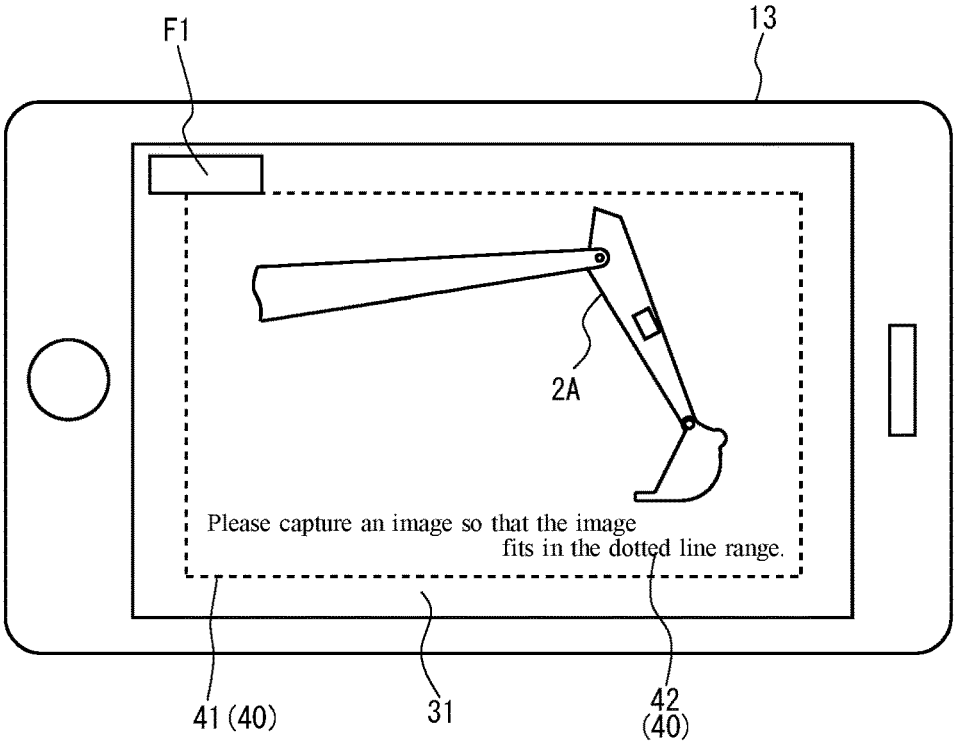
FIG. 8 is a diagram illustrating the state in which an image of an imaging target object is captured in an imageable area according to the second embodiment.

Text display (a message) such as "Please capture an image so that the image fits in the dotted line range (imagable area information 41).", for example, can be applied to the notifying information 42, and the notifying information 42 is displayed together with the display of the imagable area information 41. The notifying information 42 is displayed at a lower part of the imagable area information 41 on the display unit 31. Further, as the image-capturing person (or the operator) touch-operates an imaging icon (not illustrated) that is displayed on the display unit 31 in such a state that an imaging target object 2A is fitted within the imagable area information 41 (see FIG. 8), the imaging result is acquired. After that, an arithmetic unit 34 executes processing of receiving designation of a condition for the ideal mounting position.

As described above, in the second embodiment, the imagable area information 41 is displayed on the display unit 31, and the way to capture an image is notified in an easy-to-understand manner by using the notifying information 42. By doing so, the second embodiment is configured to enable imaging such that the imaging target object of the hydraulic shovel 2 fits inside the imagable area information 41. By such a configuration, distortion of a captured image to be obtained when capturing an image of the imaging target object is suppressed as far as possible, and it is possible to further enhance the accuracy of the posture information (i.e., to more accurately assist the operation of the operator).

In other words, while the imaging unit 32 is generally mainly composed of an imaging element and a lens (for example, a biconvex lens) positioned on a side closer to a subject (imaging target object) of the imaging element, distortion at a peripheral part of the captured image caused by the lens is less likely to occur. Further, by employing the imagable area information 41, the accuracy of the posture information can be enhanced. In addition, as the notifying information 42 is displayed on the display unit 31, the image-capturing person (the operator) can easily understand the way to perform image-capturing.

Third Embodiment

Figure 9:
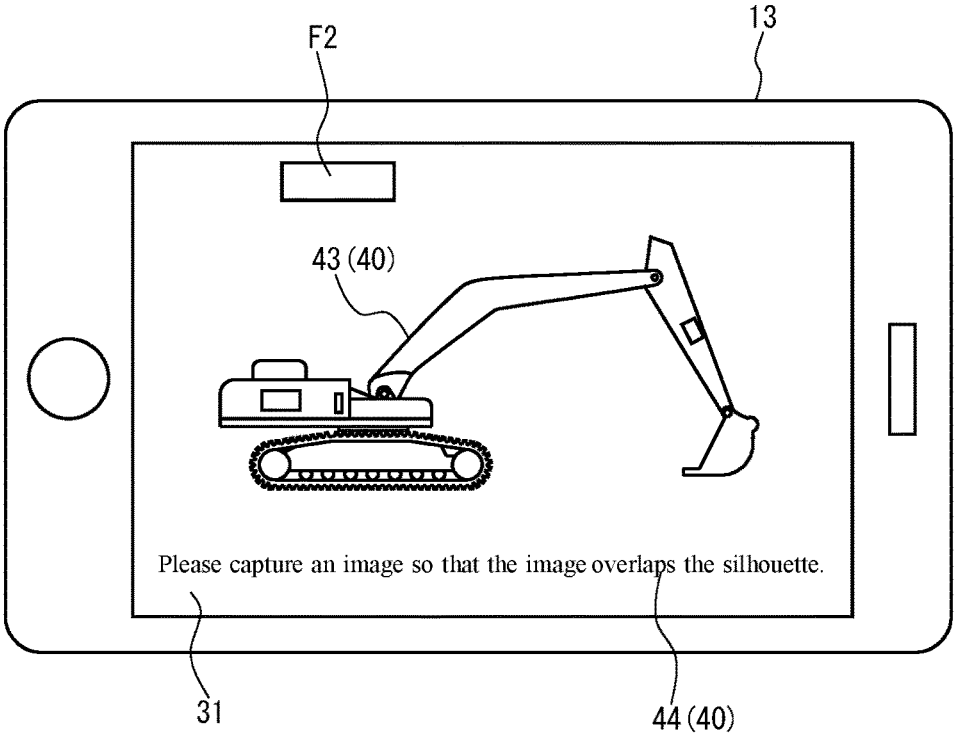
FIG. 9 is a diagram illustrating a portable information terminal device when a silhouette icon according to a third embodiment of the present invention is operated.

Next, a third embodiment of the present invention will be described. The third embodiment is configured such that model imaging information 43 of a hydraulic shovel 2 formed of a silhouette image is employed instead of the imagable area information 41 employed in the second embodiment described above. That is, imaging assistance information 40 of the third embodiment is configured to include, as illustrated in FIG. 9, the model imaging information 43 and notifying information 44 which is associated with the model imaging information 43.

For the model imaging information 43, a silhouette image representing a required part of the hydraulic shovel 2 (in this case, the entire hydraulic shovel 2) can be applied. The model imaging information 43 is displayed on a display unit 31 (for example, an area excluding the outer edge part of the display unit 31) when an image-capturing person (or an operator) touch-operates a silhouette icon F2 on the initial screen. Note that an imaging area icon F1, an imaging example icon F3, and a silhouette selection icon F4 are hidden from display when the image-capturing person (or the operator) touch-operates the silhouette icon F2.

Text display (a message) such as "Please capture an image so that the image overlaps the silhouette.", for example, can be applied to the notifying information 44, and the notifying information 44 is displayed together with the display of the model imaging information 43. The notifying information 44 is displayed under the model imaging information 43 on the display unit 31. Further, as the image-capturing person (or the operator) touch-operates the imaging icon in such a state that an imaging target object substantially overlaps the model imaging information 43, the imaging result is acquired. After that, an arithmetic unit 34 executes processing of receiving designation of a condition for the ideal mounting position.

As described above, in the third embodiment, the model imaging information 43 is displayed on the display unit 31, and the way to capture an image is notified in an easy-to-understand manner by using the notifying information 44. By doing so, the third embodiment is configured to enable imaging such that the imaging target object (the required part) of the hydraulic shovel 2 substantially overlaps the model imaging information 43. Even with such a configuration, an advantage of being able to further enhance the accuracy of the posture information can be brought about.

In other words, while an imaging unit 32 is generally mainly composed of an imaging element and a lens (for example, a biconvex lens) positioned on a side closer to a subject (imaging target object) of the imaging element, distortion at a peripheral part of a captured image caused by the lens is less likely to occur. Further, by employing the model imaging information 43, the accuracy of the posture information can further be enhanced. In addition, as the notifying information 44 is displayed on the display unit 31, the image-capturing person (the operator) can easily understand the way to perform image-capturing. In the third embodiment, while the model imaging information 43 is displayed on the display unit 31, the third embodiment may be configured to additionally display the imagable area information 41 employed in the second embodiment when the model imaging information 43 is to be displayed on the display unit 31.

Fourth Embodiment

Next, a fourth embodiment of the present invention will be described. The fourth embodiment is configured such that, in contrast to the configuration of the third embodiment described above, model imaging information 45 is displayed on a display unit 31 for a predetermined time.

Figure 10:
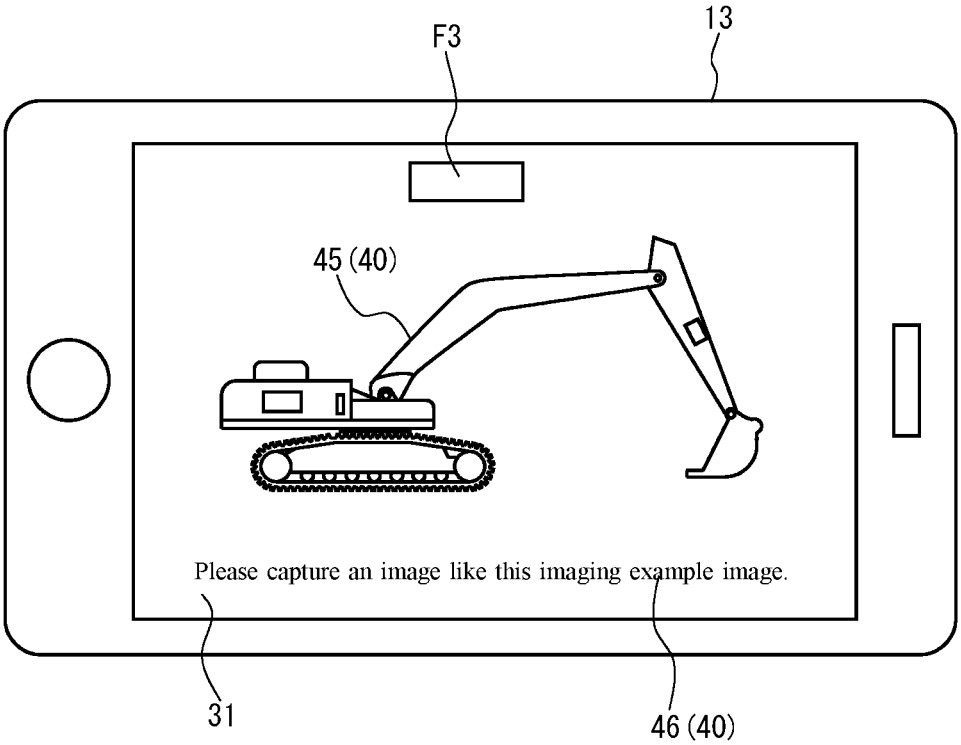
FIG. 10 is a diagram illustrating a portable information terminal device when an imaging example icon according to a fourth embodiment of the present invention is operated.
Figure 11:
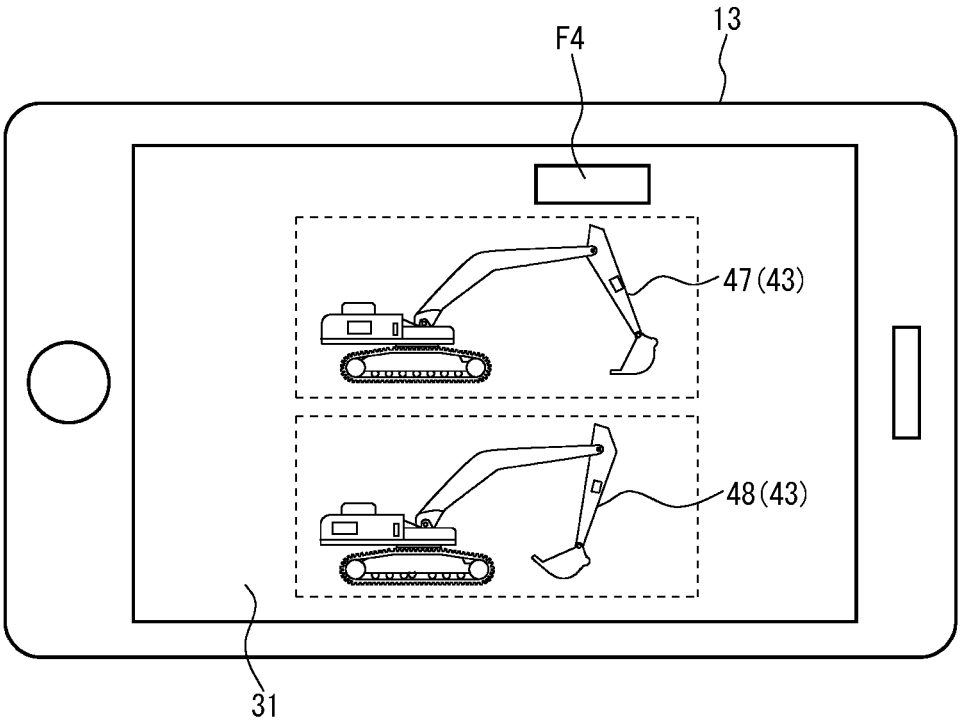
FIG. 11 is a diagram illustrating a portable information terminal device when a silhouette selection icon according to a fifth embodiment of the present invention is operated.
Figure 12:
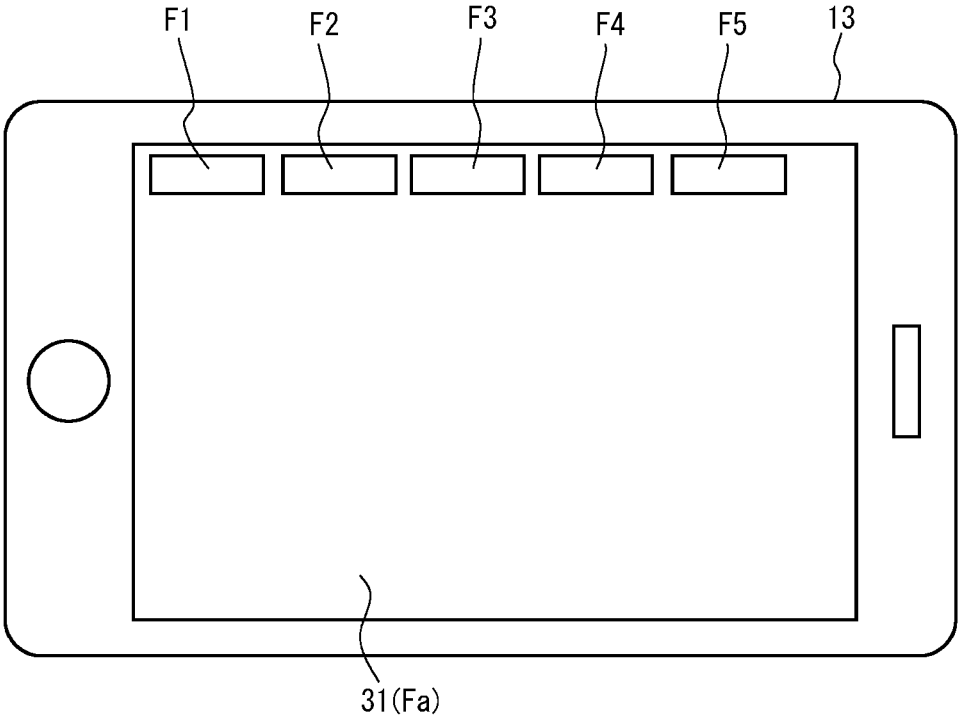
FIG. 12 is a diagram illustrating the state in which icons related to operational assistance are displayed on a portable information terminal device according to a sixth embodiment of the present invention.

Imaging assistance information 40 of the fourth embodiment is configured to include, as illustrated in FIG. 10, the model imaging information 45 and notifying information 46 which is associated with the model imaging information 45. For the model imaging information 45, an imaging example image not subjected to silhouette processing as compared to the model imaging information 43 employed in the above third embodiment can be applied. The model imaging information 45 is displayed on the display unit 31 for a predetermined time (for example, five to ten seconds) when an image-capturing person (or an operator) touch-operates an imaging example icon F3 on the initial screen. After the predetermined time has elapsed, the display unit 31 automatically transitions to a screen capable of capturing an image of an imaging target object. Note that an imaging area icon F1, a silhouette icon F2, and a silhouette selection icon F4 are hidden from display when the image-capturing person (or the operator) touch-operates the imaging example icon F3.

Text display (a message) such as "Please capture an image like this imaging example image.", for example, can be applied to the notifying information 46, and the notifying information 46 is displayed together with the display of the model imaging information 45. The notifying information 46 is displayed under the model imaging information 45 on the display unit 31. Further, as the image-capturing person (or the operator) touch-operates the imaging icon in such a state that an imaging target object is determined as being substantially the same as the model imaging information 45, the imaging result is acquired. After that, an arithmetic unit 34 executes processing of receiving designation of a condition for the ideal mounting position.

As described above, in the fourth embodiment, the model imaging information 45 is displayed on the display unit 31, and the way to capture an image is notified in an easy-to-understand manner by using the notifying information 46. By doing so, the effect and advantage which are similar to those of the third embodiment described above can be obtained. It has been described that a transition is automatically made for the model imaging information 45 to present a screen capable of capturing an image of an imaging target object after a lapse of the predetermined time. However, it is also possible to adopt a configuration in which a touch operation on a screen return icon (not illustrated) that is displayed on the display unit 31 (provided as an operation unit 33) causes a transition to a screen that is capable of capturing an image of the imaging target object.

Fifth Embodiment

Next, a fifth embodiment of the present invention will be described. The fifth embodiment is configured such that model imaging information 43 as a silhouette image employed in the third embodiment described above can be selected from among a plurality of pieces model imaging information 43.

In this case, as an image-capturing person (an operator) touch-operates (operates) a silhouette selection icon F4 on the initial screen, a plurality of selection candidates of the model imaging information 43, i.e., the silhouette images, are displayed on a display unit 31. For example, the present embodiment is configured such that by the operation on the silhouette selection icon F4, as the selection candidates, a first selection image 47 and a second selection image 48 are displayed one above the other in line on the display unit 31. At this time, the display unit 31 may be configured to present text display (notifying information), such as "Please select the one that is close to the imaging target object", together with the display of each of the selection images 47 and 48.

Further, although detailed illustration is omitted here, for example, when the image-capturing person (the operator) has selected the first selection image 47 from the selection images 47 and 48 (i.e., when a part of an operation unit 33 corresponding to the first selection image 47 is touch-operated), a silhouette image corresponding to the first selection image 47 is displayed on the display unit 31 as in the case of the third embodiment (FIG. 9) described above. In other words, this means that, as the image-capturing person (the operator) selects one of the selection candidates (e.g., the first selection image 47) from among a plurality of selection candidates (the selection images 47 and 48), a silhouette image corresponding to the first selection image 47 that has been selected is displayed on the display unit 31.

Further, as the image-capturing person (the operator) touch-operates the imaging icon in such a state that an imaging target object substantially overlaps the silhouette image corresponding to the first selection image 47, the imaging result is acquired, and an arithmetic unit 34 executes processing of receiving designation of a condition for the ideal mounting position. Even with such a configuration, the effect and advantage which are similar to those of the third embodiment described above can be obtained.

Sixth Embodiment

Next, a sixth embodiment of the present invention will be described with reference to FIGS. 12 to 15. The sixth embodiment enables, when an image-capturing person is to capture an image of an imaging target object (i.e., the required part of a hydraulic shovel 2), the reference mounting position to be set virtually even under the circumstances in which a rotary shaft 5A (a rotation center 5B) of an arm 5 corresponding to a moving part is invisible from the image-capturing person's side.

First, it is assumed that as the image-capturing person touch-operates the functionality expansion icon, an initial screen Fa which consists of an imaging area icon F1, a silhouette icon F2, an imaging example icon F3, a silhouette selection icon F4, and a first reference point estimation icon F5 is displayed on the upper part of a display unit 31. If necessary, the initial screen Fa illustrated in FIG. 12 may display a message which instructs that the first reference point estimation icon F5, which serves as an operation unit 33, should be selected, as appropriate.

Figure 13:
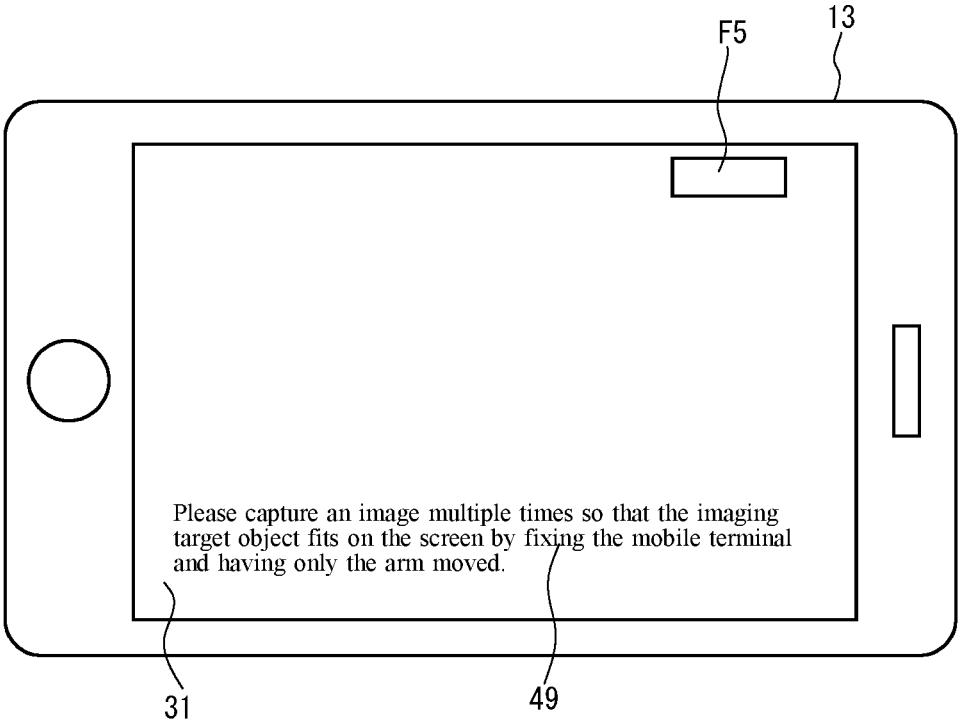
FIG. 13 is a diagram illustrating a portable information terminal device when a rotary shaft estimation icon according to the sixth embodiment is operated.

Here, the image-capturing person checks whether the rotary shaft 5A (the rotation center 5B) of the arm 5 is visible from the image-capturing person's side. If the rotary shaft 5A (the rotation center 5B) is invisible for some reason (e.g., poor visibility on the upper side from above the vicinity of the rotary shaft 5A) from the side of the image-capturing person who is capturing an image of an imaging target object (i.e., the required part of a hydraulic shovel 2), the first reference point estimation icon (rotary shaft estimation icon) F5 is touch-operated. FIG. 13 illustrates the display unit 31 to be presented after the first reference point estimation icon F5 has been touch-operated. In FIG. 13, icons F1 to F4 are hidden from display, and notifying information 49 is displayed at the lower side of the display unit 31. Text display (a message) such as "Please capture an image multiple times so that the imaging target object fits on the screen by fixing the mobile terminal and having only the arm moved.", for example, can be applied to the notifying information 49.

Next, the image-capturing person performs the imaging for the first time. The image-capturing person captures an image of an imaging target object 2B, which is the required part of the hydraulic shovel 2, as shown in illustration FIG. 14A. It is assumed that the imaging target object 2B is the entire hydraulic shovel 2. After that, the image-capturing person performs the imaging for the second time (see illustration of FIG. 14B) with a portable information terminal device 13 being unmoved and the arm 5 corresponding to a moving part being slightly lowered from the state of illustration of FIG. 14A. Further, the image-capturing person performs the imaging for the third time (see illustration of FIG. 14C) with the portable information terminal device 13 being unmoved and the arm 5 corresponding to the moving part being slightly moved nearer from the state of illustration FIG. 14B. After the imaging for the third time has been performed, a first reference point calculation icon F6 is displayed directly below the first reference point estimation icon F5.

As can be seen, in the sixth embodiment, of a boom 4, the arm 5, and a bucket 6, it is assumed that only the arm 5 is movable. Further, the arm 5 is provided with the above-described rotation center 5B whose position remains unchanged when the arm 5 is operated, and the above-described rotation center 6B which is provided in the vicinity of a part where the arm 5 and the bucket 6 are coupled, and the position of which changes when the arm 5 is operated. Here, the rotation centers 5B and 6B of the sixth embodiment correspond to first and second reference points to be later recited in the claims, respectively, and the rotation center 5B will be hereinafter described as a first reference point 5B and the rotation center 6B will be described as a second reference point 6B.

Figure 15:
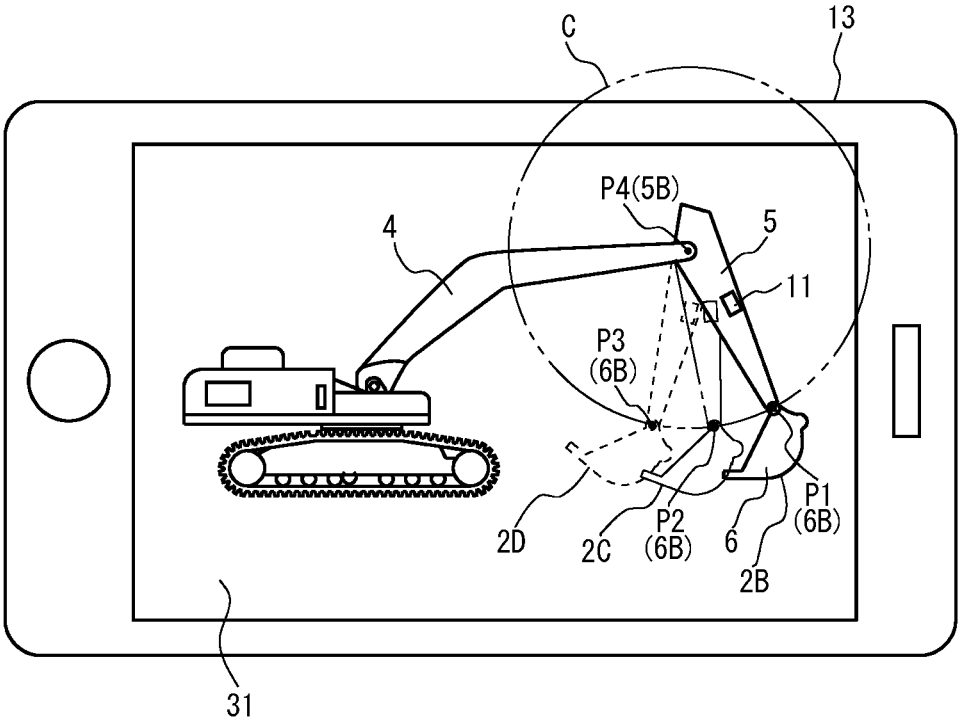
FIG. 15 is a diagram for use in describing rotary shaft estimation according to the sixth embodiment.

Next, the image-capturing person touch-operates the first reference point calculation icon F6. By the touch operation on the first reference point calculation icon F6, a composite captured image in which the imaging target object 2B, imaging target object 2C, and imaging target object 2D overlap one another is displayed on the display unit 31, as illustrated in FIG. 15. In the above, with respect to the second reference point 6B of the bucket 6 provided in the vicinity of the part where the arm 5 and the bucket 6 are coupled, the second reference point 6B corresponding to the imaging target object 2B is set to a first virtual point P1, the second reference point 6B corresponding to the imaging target object 2C is set to a second virtual point P2, and the second reference point 6B corresponding to the imaging target object 2D is set to a third virtual point P3.

An arithmetic unit 34 computes a center point P4 of a circle C passing through the second reference points 6B at the three places (i.e., each of the virtual point P1 to P3), which are obtained by operating the arm 5 and capturing an image of the required part of the hydraulic shovel 2, by using an equation of a circle. The arithmetic unit 34 executes processing of virtually defining the center point P4 of the circle C as the first reference point 5B of the arm 5.

Next, the arithmetic unit 34 proceeds to processing of designating a condition for the reference mounting position. Here, as in the first embodiment, the arithmetic unit 34 executes processing of setting a straight line L connecting the first reference point 5B and the second reference point 6B to the reference mounting position. After that, the arithmetic unit 34 executes processing of calculating a mounting error of a sensor unit 11 with respect to the reference mounting position, correcting the posture information, and sending the corrected posture information to the hydraulic shovel 2 as information for assisting the operation of the operator.

When the first reference point 5B is virtually defined as in the sixth embodiment, it is not necessary to separately capture an image of a new imaging target object in addition to the image-capturing of the imaging target objects 2B to 2D. It is sufficient if one of images (for example, an image of the imaging target object 2B) of the three images of the imaging target objects 2B to 2D is used to perform the processing of setting the reference mounting position, calculating the mounting error, correcting the posture information, and sending the corrected posture information to the hydraulic shovel 2. Further, it has been described that the imaging target objects 2B to 2D are those captured in a state in which the arm 5 is temporarily stopped, but an image of the arm 5 in a state in which the arm 5 is moving may be captured multiple times (for example, three times or more) at fixed intervals.

Other Embodiments

While specific configurations suitable for the implementation of the present invention have been described in detail above, the configurations of the embodiments described above can be variously changed without departing from the gist of the present invention.

That is, in the embodiments described above, the case in which the posture information is corrected on the portable information terminal device side has been described. However, the present invention is not limited to the above, and the correction may be executed on the hydraulic shovel side.

Further, in the embodiments described above, the case of providing information for assisting the operation of the operator with reference to the inclination of the arm 5 has been described. However, the present invention is not limited to the above, and can be widely applied to, for example, a case of providing information for assisting an operation of an operator with reference to the necessary amount of movement to a work construction target.

Furthermore, in the above embodiments, it has been described that information for assisting the operation of the hydraulic shovel 2 is provided. However, information for assisting an operation of a working machine other than the hydraulic shovel 2 such as a working machine for farming, for example, may be provided.

Also, in the sixth embodiment described above, an example of estimating the rotation center (first reference point) 5B of the arm 5, which is not visible from the image-capturing person's side, has been described. However, it is needless to say that the present embodiment can also be applied to a case where, under the circumstances in which the sensor unit is also attached (fixed) to the boom 4 and the bucket 6, for example, the rotation center positioned on a lower end side of the boom 4 corresponding to a moving part is not visible from the image-capturing person's side for some reason (for example, by being hidden by a control room of the hydraulic shovel 2), or a case where the rotation center 6B of the bucket 6 corresponding to a moving part is not visible from the image-capturing person's side.

Figure 14A:
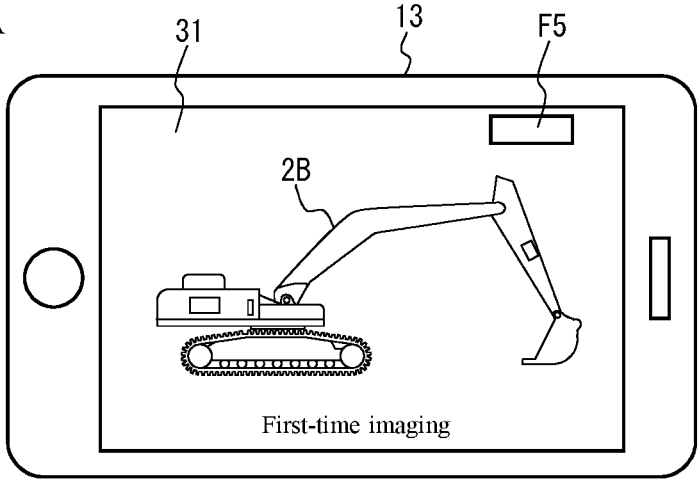
FIGS. 14A-14C are diagrams illustrating the state of imaging at the time when the position of an arm is changed according to the sixth embodiment.
Figure 14B:
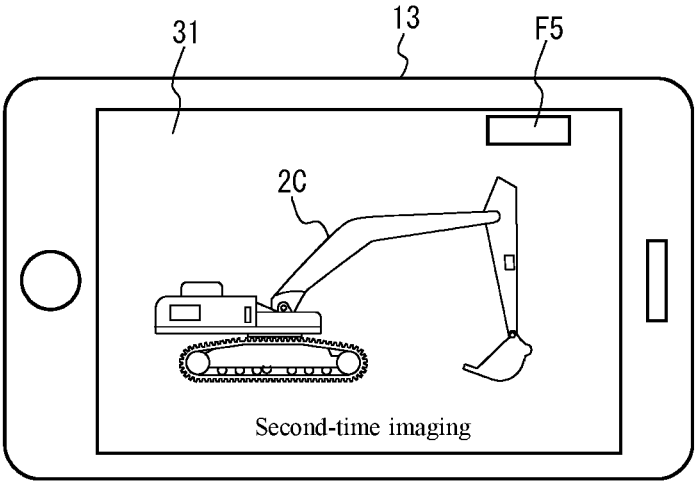
Figure 14C:
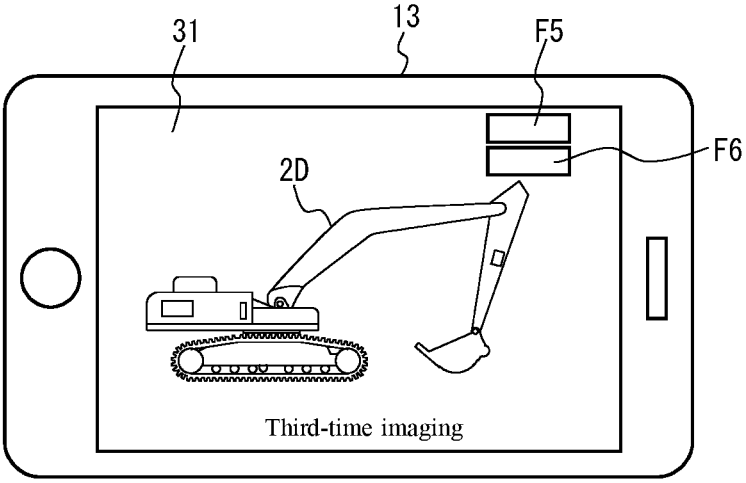

Further, in the above sixth embodiment, it has been described that the images of the three imaging target objects 2B to 2D are used to estimate the first reference point 5B. However, images of four or more imaging target objects may be used to estimate the first reference point 5B. In the sixth embodiment described above, while images are captured by moving the arm 5 stepwise as illustrated in FIGS. 14A-14C, three or more images to be obtained when the arm 5 is moved continuously may be captured.

DESCRIPTION OF REFERENCE NUMERALS

1 Work assistance system
2 Hydraulic shovel
2A Imaging target object
3 Body
4 Boom
5 Arm
5A Rotary shaft
5B Rotation center (first reference point)
6 Bucket
6A Rotary shaft
6B Rotation center (second reference point)
11 Sensor unit
12, 23, 35 Communication unit
13 Portable information terminal device
14 Notification unit
21 Detection unit
22, 34 Arithmetic unit
31 Display unit
32 Imaging unit
33 Operation unit
40 Imaging assistance information
41 Imagable area information
42, 44, 46 Notifying information
43, 45 Model imaging information
47 First selection image
48 Second selection image
C Circle
F Initial screen
F1 Imaging area icon
F2 Silhouette icon
F3 Imaging example icon
F4 Silhouette selection icon
F5 First reference point estimation icon
F6 First reference point calculation icon
L Straight line
P4 Center point of circle

The invention claimed is:

1. A method for controlling a work assistance system which assists work of an operator by a machine guidance function, the method comprising:

acquiring an imaging result of a moving part of a working machine holding a sensor unit;

performing image processing on the imaging result, and calculating a mounting error of the sensor unit with respect to a reference mounting position, wherein the mounting error represents a physical spatial deviation between an actual installation position of the sensor unit and the reference mounting position on the moving part, wherein the reference mounting position is a predetermined position at which the sensor unit is designed to be correctly mounted;

registering data regarding the mounting error;

acquiring posture information by means of an inertial measurement unit sensor provided in the sensor unit;

correcting the posture information by using the registered data; and sending out the corrected posture information as information for assisting the work of the operator, wherein, during operation of the working machine, the posture information is repeatedly acquired from the sensor on the moving part of the working machine, wherein correcting the posture information includes applying a correction corresponding to the mounting error to the posture information to generate corrected posture information, and wherein the machine guidance function uses the corrected posture information to update, in real time, guidance output presented on an operator interface display or generate a control signal for a control system of the working machine.

2. The method for controlling the work assistance system according to claim 1, wherein:

the imaging result is acquirable by capturing an image of the moving part by an imaging unit provided in a portable information terminal device; and imaging assistance information is displayed on a display unit of the portable information terminal device before an image of the moving part is captured by the imaging unit.

3. The method for controlling the work assistance system according to claim 2, wherein the imaging assistance information includes at least one of imageable area information that is displayed on the display unit and model imaging information of the working machine that is displayed on the display unit.

4. The method for controlling the work assistance system according to claim 3, wherein the display unit displays notifying information associated with the imageable area information or the model imaging information.

5. The method for controlling the work assistance system according to claim 3, wherein the model imaging information is a silhouette image.

6. The method for controlling the work assistance system according to claim 3, wherein the model imaging information is displayed on the display unit for a predetermined time when a model imaging icon displayed on the display unit is operated.

7. The method for controlling the work assistance system according to claim 5, wherein:

a plurality of selection candidates of the silhouette image are displayed on the display unit by operating a silhouette selection icon displayed on the display unit; and by selecting one selection candidate from among the plurality of selection candidates, the silhouette image having been selected is displayed on the display unit.

8. The method for controlling the work assistance system according to claim 1, wherein:

the moving part includes a first reference point whose position remains unchanged when the moving part is operated, and a second reference point whose position is changed when the moving part is operated; and the work assistance system comprises an arithmetic unit which virtually defines, as the first reference point, a center point of a circle passing through the second reference points at three places or more obtained by operating the moving part and capturing an image of a required part of the working machine.

9. The method for controlling the work assistance system according to claim 8, wherein the arithmetic unit sets a straight line, which connects the first reference point which is invisible from a side of an image-capturing person who captures an image of the required part of the working machine and the second reference point, to the reference mounting position defined virtually.

* * * * *